US010102807B2

(12) United States Patent
Lim et al.

(10) Patent No.: US 10,102,807 B2
(45) Date of Patent: Oct. 16, 2018

(54) DISPLAY DEVICE UTILIZING A DATA DRIVER ACCOUNTING FOR PARASITIC CAPACITANCES

(71) Applicant: Samsung Display Co., Ltd., Yongin-si, Gyeonggi-do (KR)

(72) Inventors: Jae Keun Lim, Suwon-si (KR); Jong Hee Kim, Yongin-si (KR); Ji-Sun Kim, Seoul (KR); Young Wan Seo, Suwon-si (KR); Chong Chul Chai, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 119 days.

(21) Appl. No.: 15/157,350

(22) Filed: May 17, 2016

(65) Prior Publication Data

US 2016/0379566 A1 Dec. 29, 2016

(30) Foreign Application Priority Data

Jun. 24, 2015 (KR) ..... 10-2015-0089707

(51) Int. Cl.
*G09G 5/00* (2006.01)
*G09G 3/3283* (2016.01)
*G09G 3/3233* (2016.01)

(52) U.S. Cl.
CPC ..... *G09G 3/3283* (2013.01); *G09G 3/3233* (2013.01); *G09G 2300/0426* (2013.01); *G09G 2300/0819* (2013.01); *G09G 2300/0842* (2013.01); *G09G 2300/0861* (2013.01); *G09G 2310/08* (2013.01); *G09G 2320/0209* (2013.01)

(58) Field of Classification Search
CPC ..... G09G 3/3283; G09G 3/3233; G09G 2300/0861; G09G 2300/0842; G09G 2300/0819; G09G 2300/0426; G09G 2320/0209; G09G 2310/08
See application file for complete search history.

(56) References Cited

U.S. PATENT DOCUMENTS

2007/0057877 A1* 3/2007 Choi ..... G09G 3/3233 345/76

FOREIGN PATENT DOCUMENTS

| | | |
|---|---|---|
| JP | 2007-199347 A | 8/2007 |
| KR | 10-2010-0061301 | 6/2010 |
| KR | 10-2012-0109805 | 10/2012 |

* cited by examiner

*Primary Examiner* — Jonathan Boyd
(74) *Attorney, Agent, or Firm* — Lewis Roca Rothgerber Christie LLP

(57) ABSTRACT

There is provided a display device including a display including a first pixel connected to a first data line and a second pixel connected to a second data line, a data signal generator configured to generate an output signal, and a signal divider configured to divide the output signal, to generate a first data signal and a second data signal, and to apply the first data signal and the second data signal to the first data line and the second data line, respectively, wherein the data signal generator is configured to generate the output signal based on a coupling effect of a first parasitic capacitor formed between the first data line and the second data line and a coupling effect of a parasitic capacitor of a data line formed by the first data line and second data line.

9 Claims, 4 Drawing Sheets

DISPLAY DEVICE UTILIZING A DATA DRIVER ACCOUNTING FOR PARASITIC CAPACITANCES

CROSS-REFERENCE TO RELATED APPLICATION

This application claims priority to, and the benefit of, Korean Patent Application No. 10-2015-0089707, filed in the Korean Intellectual Property Office on Jun. 24, 2015, the entire content of which is incorporated herein by reference.

BACKGROUND

1. Field

The described technology relates generally to a display device.

2. Description of the Related Art

Various types of flat organic light emitting displays generally include liquid crystal displays (LCDs), field emission displays (FEDs), plasma display panels (PDPs), and organic light emitting displays (OLEDs).

In general, an organic light emitting display using an organic light emitting diode (OLED) among the flat organic light emitting displays is a flat-type display using electric field emission of an organic material. Light emission of the OLED is achieved using a mechanism in which electrons and holes are injected from electrodes, and when excitons generated by coupling the holes and electrons fall from an excited state to a ground state, light is emitted.

The organic light emitting display does not require an additional light source, and thus the thickness and weight thereof may be reduced. Because the organic light emitting display has a fast response speed, and at the same time has excellent light emission efficiency, luminance, and viewing angle, the organic light emitting display can be used for electronic products, such as portable terminals or large televisions.

The organic light emitting diode (OLED) display includes a data driver transmitting a data signal to a plurality of data lines, a scan driver sequentially transmitting a scan signal to a plurality of scan lines, and a plurality of pixels connected to the plurality of scan lines and the plurality of data lines. Each pixel supplies a current corresponding to the corresponding data signal to an organic light emitting diode (OLED), and the organic light emitting diode (OLED) emits light according to the supplied current amount.

When increasing the number of pixels to improve the resolution of the organic light emitting diode (OLED) display, a plurality of pixels connected to one scan line are connected to different data lines, such that the number of data lines is proportionally increased. Accordingly, the circuit of the data driver becomes more complicated, and manufacturing cost thereof is increased.

To solve this, a demultiplexer for selectively outputting one input signal to one among a plurality of output lines is used. That is, by sequentially applying the data signal output from the data driver to the plurality of data lines through the demultiplexer of a 1:n type, the circuit of the data driver may be simplified.

As described above, for the organic light emitting diode (OLED) display using the demultiplexer, to prevent or substantially prevent the data signal input to each pixel during a current horizontal period from being influenced by the data signal applied during the previous horizontal period, each horizontal period is divided into a writing period in which the data signal is written, and a scan period in which the data signal is transmitted to each pixel according to the scan signal.

The above information disclosed in this Background section is for enhancement of understanding of the background of the described technology, and therefore it may contain information that does not form the prior art that is already known in this country to a person of ordinary skill in the art.

SUMMARY

Aspects of embodiments of the present invention are directed to a display device for reducing a coupling effect formed among neighboring data lines.

Technical aspects of the present invention are not limited by the above described technical aspect, and the technical aspects that are described will be clearly comprehended by a person of ordinary skill in the art.

According to an exemplary embodiment of the present invention, there is provided a display device including: a display including a first pixel connected to a first data line and a second pixel connected to a second data line; a data signal generator configured to generate an output signal; and a signal divider configured to divide the output signal, to generate a first data signal and a second data signal, and to apply the first data signal and the second data signal to the first data line and the second data line, respectively, wherein the data signal generator is configured to generate the output signal based on a coupling effect of a first parasitic capacitor formed between the first data line and the second data line and a coupling effect of a parasitic capacitor of a data line formed by the first data line and second data line.

In an embodiment, the data signal generator is configured to generate the output signal based on a first coupling effect of the first parasitic capacitor caused when the first data signal changes from a first level to a second level at a first time and a coupling effect of the parasitic capacitor of the data line.

In an embodiment, the first pixel and the second pixel are adjacent each other in a vertical direction.

In an embodiment, the first data signal changes from a first level to a second level at a first time, and the generated output signal is written to the second pixel at a second time.

In an embodiment, the generated output signal reduces the coupling effect of the parasitic capacitor in proportion to a square of a ratio of the first parasitic capacitor to the parasitic capacitor of the data line.

In an embodiment, the data signal generator is configured to generate the output signal based on a first coupling effect, a second coupling effect of the first parasitic capacitor caused when the second data signal changes from a third level to a fourth level at a third time, and a coupling effect of the parasitic capacitor of the data line.

In an embodiment, the display device further including a third pixel connected to the first data line and below the first pixel, the second pixel is between the first pixel and the third pixel in a vertical order.

In an embodiment, the generated output signal is written to the second pixel based on a first coupling effect, a second coupling effect of the first parasitic capacitor caused when the second data signal changes from a third level to a fourth level at a third time, and a coupling effect of the parasitic capacitor of the data line.

In an embodiment, the generated output signal generated based on a first coupling effect, a second coupling effect of the first parasitic capacitor caused when the second data signal changes from a third level to a fourth level at a third time, and a coupling effect of the parasitic capacitor of the data line reduces a coupling effect of the parasitic capacitor in proportion to a cube of a ratio of the first parasitic capacitor to the parasitic capacitor of the data line.

The display device according to the exemplary embodiment reduces the coupling effect occurring among the neighboring data lines.

DETAILED DESCRIPTION

Figure 1:
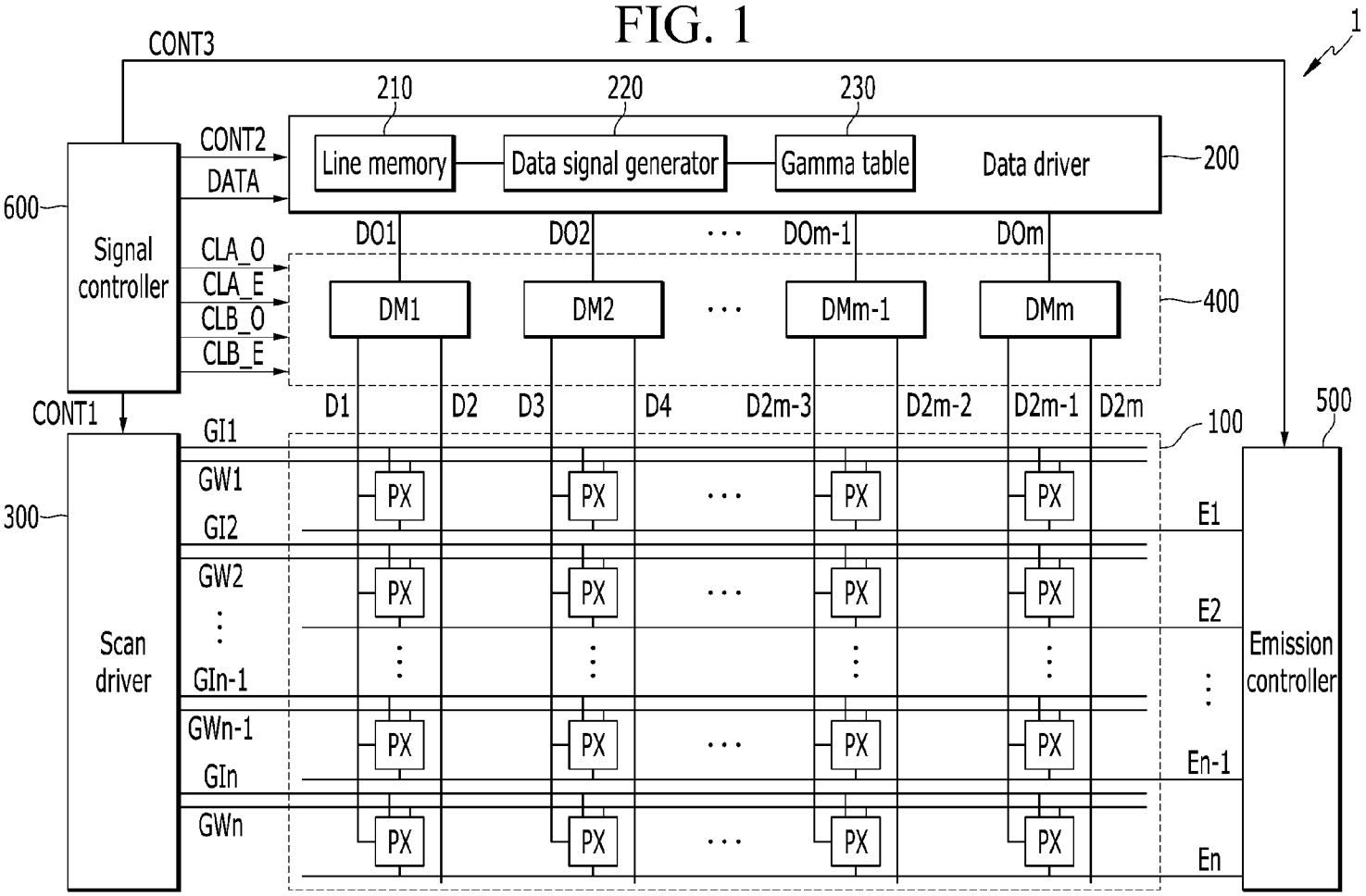
FIG. 1 illustrates a block diagram of a display device according to an exemplary embodiment.

Hereinafter, exemplary embodiments disclosed in the present specification will be described in detail with reference to the accompanying drawings. In the present specification, the same or similar components will be denoted by the same or similar reference numerals, and an overlapped description thereof will be omitted. In describing exemplary embodiments of the present specification, when it is determined that a detailed description of the well-known art associated with the present invention may obscure the gist of the present invention, it will be omitted. The accompanying drawings are provided only in order to allow exemplary embodiments disclosed in the present specification to be easily understood and are not to be interpreted as limiting the spirit disclosed in the present specification, and it is to be understood that the present invention includes all modifications, equivalents, and substitutions without departing from the scope and spirit of the present invention.

A display device according to an exemplary embodiment will now be described with reference to FIG. 1.

FIG. 1 illustrates a block diagram of a display device according to an exemplary embodiment.

The display device 1 includes a display unit (e.g., display) 100, a data driver 200, a scan driver 300, a signal divider 400, an emission controller 500, and a signal controller 600.

The display unit 100 includes a plurality of pixels (PX) connected to a plurality of signal lines (GI1-GWn, GW1-GWn, E1-En, and D1-D2*m*) and substantially arranged in a matrix form.

The signal lines (GI1-GIn, GW1-GWn, E1-En, and D1-D2*m*) include a plurality of scanning lines (GW1-GWn) for transmitting scanning signals, a plurality of initialization scanning lines (GI1-GIn) for transmitting initialization signals, a plurality of data lines (D1-D2*m*) for transmitting data signals according to an input image signal, and a plurality of emission scanning lines (E1-En) for transmitting emission scanning signals for controlling emission. The scanning lines (GI1-GIn and GW1-GWn) substantially extend in a row direction and are substantially in parallel with each other, the data lines (D1-D2*m*) substantially extend in a column direction (that is orthogonal to the row direction) and are substantially in parallel with each other, and the emission scanning lines (E1-En) substantially extend in the row direction and are substantially in parallel with each other. A plurality of pixels (PX) is formed at respective crossing regions of the scanning lines (G1-Gn) and the data lines (D1-D2*m*).

The data driver 200 is connected to the data lines (D1-D2*m*) of the display unit 100, and applies a data signal (DATA) to output lines (DO1-DOm). The data driver 200 may select the data signal (DATA) from all gray voltages relating to luminance of the pixel (PX), or may generate the desired data signal (DATA) by dividing gray voltages of a limited number.

The data driver 200 may include a line memory 210, and may store the data signal (DATA) applied to the plurality of data lines (D1-D2*m*) to the line memory 210 for each pixel (PX) line.

The data driver 200 includes a data signal generator 220, which may generate a data signal (DATA) by using the data signal stored in the line memory 210. The data signal generator 220 may generate an output signal by compensating an influence of the data signal supplied to the pixels above and below a reference pixel according to a coupling effect of parasitic capacitors (e.g., Cd1 and Cd2 of FIG. 3) and a data line capacitor (e.g., Cdata of FIG. 3).

Figure 3:
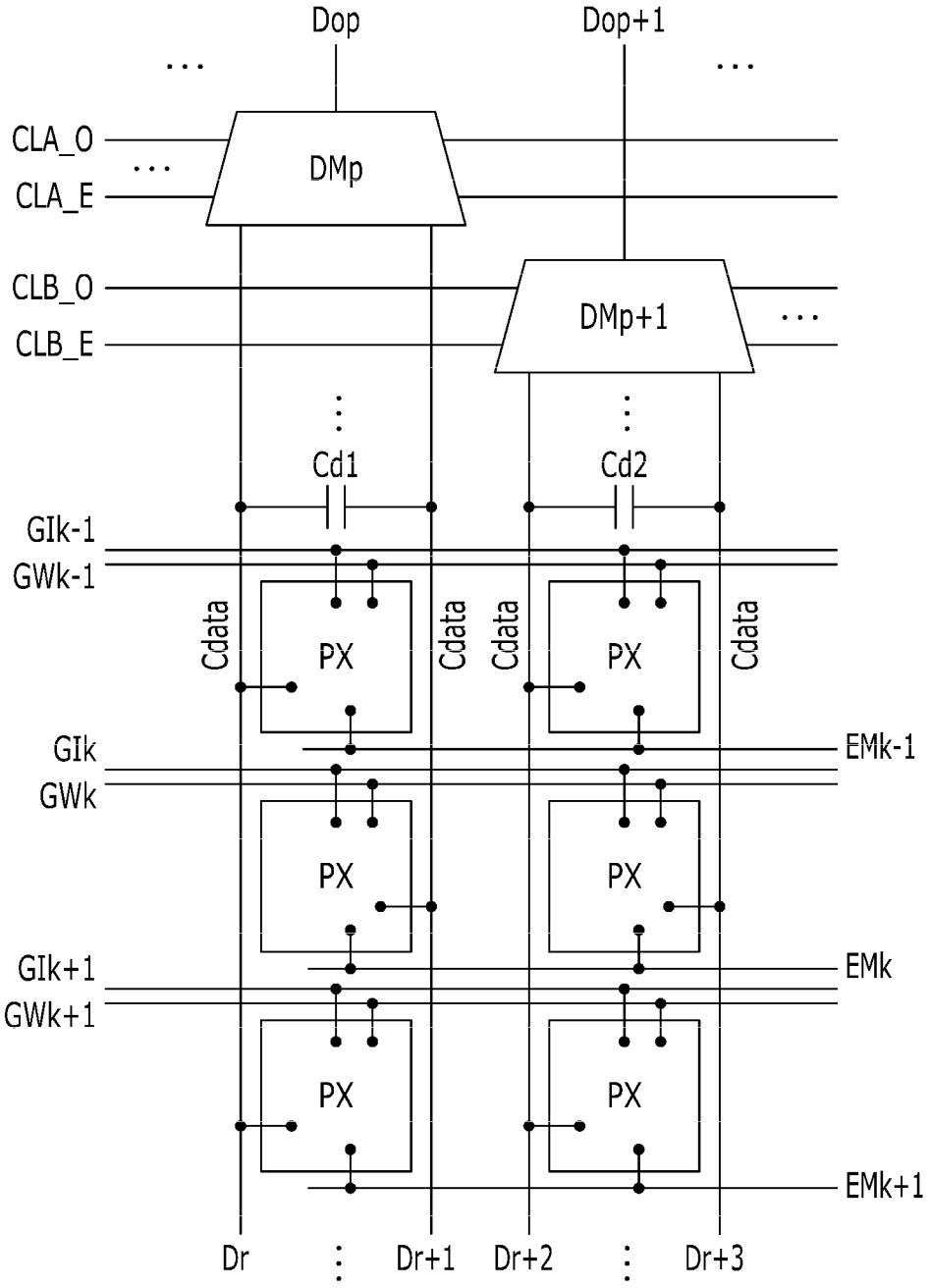
FIG. 3 illustrates part of a signal divider of FIG. 1 and a corresponding pixel.

A data processing operation will signify an operation for the data signal generator 220 to compensate the data signal (DATA) of the reference pixel (PX) based on (e.g., in consideration of) the coupling effect of the parasitic capacitors (e.g., Cd1 and Cd2 of FIG. 3) and the data line capacitor (e.g., Cdata of FIG. 3).

The data driver 200 further includes a gamma table 230, and may compare a data-processed data signal and the gamma table to perform temporal and spatial dithering and to generate a data signal.

A method of generating a data signal (DATA) by the data driver 200 will now be described in detail.

The scan driver 300 is connected to scanning lines (GI1-GIn and GW1-GWn) of the display unit 100, and applies to the scanning lines (GI1-GIn and GW1-GWn) a scanning signal, which is a combination of a voltage for turning on switching transistors of a pixel (PX) and of a dummy pixel (DPX), and a low voltage for turning off the same, according to a scan driving control signal (CONT1).

The signal divider 400 is connected between a plurality of output lines (DO1-DOm) and the plurality of data lines (D1-D2*m*), and divides a plurality of data signals between the plurality of data lines (D1-D2*m*) according to first to fourth clock signals (CLA_O, CLA_E, CLB_O, and CLB_E). That is, the signal divider 400 divides a plurality of data signals among the plurality of data lines (D1-D2*m*) according to a corresponding clock signal from among the first to fourth clock signals (CLA_O, CLA_E, CLB_O, and CLB_E).

For this purpose, the signal divider 400 includes a plurality of demultiplexers (DM1-DMm) corresponding to a plurality of pixels (PX). The demultiplexers (DM1-DMm) respectively connect a corresponding one of the plurality of output lines (DO1-DOm) and a corresponding one of the plurality of data lines (D1-D2*m*) according to the first to fourth clock signals (CLA_O, CLA_E, CLB_O, and CLB_E).

The emission controller 500 is connected to emission scanning lines (E1-En) of the display unit 100, and applies an emission scanning signal that is a combination of a voltage for turning on an emission transistor of the pixel (PX), and a low voltage for turning off the same according to an emission driving control signal (CONT3) to the emission scanning line (E1-En).

The signal controller 600 generates a data driving control signal (CONT2), the scan driving control signal (CONT1), first to fourth clock signals (CLA_O, CLA_E, CLB_O, and CLB_E), and an emission driving control signal (CONT3) for controlling the data driver 200, the scan driver 300, the signal divider 400, and the emission controller 500, respectively.

The driving devices (200, 300, 400, 500, and 600) may be mounted as at least one integrated circuit on the display unit 100, may be installed on a flexible printed circuit film, may be attached as a tape carrier package (TCP) to the display unit 100, or may be mounted on an additional printed circuit board (PCB).

Differing from this, the driving devices (200, 300, 400, 500, and 600) may be integrated on the display unit 100 together with the signal lines (GI1-GIn, GW1-GWn, D1-D2*m*, and E1-En) and the transistor. The driving devices (200, 300, 400, 500, and 600) may be integrated into a single chip, and in this case, at least one of them, or at least one circuit element configuring them, can be provided outside the single chip.

The pixel circuit of FIG. 1 will now be further described with reference to FIG. 2.

Figure 2:
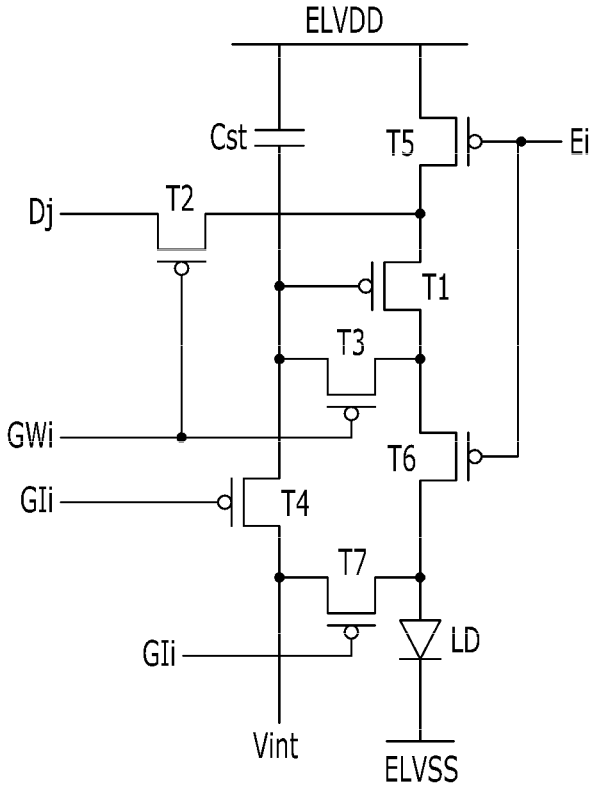
FIG. 2 illustrates a pixel circuit of a pixel of FIG. 1.

FIG. 2 illustrates a pixel circuit of a pixel of FIG. 1.

Referring to FIG. 2, each pixel (PX), for example, a pixel (PX) connected to an i-th (where i=1, 2, . . . , n) initialization scanning line and an i-th scanning line (GIi, GWi) and a j-th (where j=1, 2, . . . , m) data line (Dj), includes an organic light emitting element (LD), a driving transistor (T1), a storage capacitor (Cst), and a plurality of switching transistors (T2, T3, T4, T5, T6, and T7).

The driving transistor (T1) and the plurality of switching transistors (T2-T7) each include a control terminal and two input/output terminals. The driving transistor (T1) and the switching transistors (T2-T7) of the present embodiment are p-channel field effect transistors (FETs) made of amorphous silicon, polysilicon, or the like, and the control terminal and the input/output terminals may be a gate, a source, and a drain. However, at least one of the driving transistor (T1) and the switching transistors (T2-T7) may be an n-channel field effect transistor. In this case, a connection state of the driving transistor (T1), the switching transistors (T2-T7), the capacitor (Cst), and the organic light emitting element (LD) to be described may be changed.

The switching transistor (T2) includes a control terminal connected to the scanning line (GWi), a first input/output terminal connected to the data line (Dj), and a second input/output terminal connected to a first input/output terminal of the driving transistor (T1). The switching transistor (T2) transmits a data signal (Vdata) applied to the data line (Dj) in response to a low-voltage scanning signal applied to the scanning line (GWi).

The switching transistor (T3) includes a control terminal connected to the scanning line (GWi), and a first input/output terminal and a second input/output terminal connected to a control terminal and a second input/output terminal of the driving transistor (T1). The switching transistor (T3) diode-connects the driving transistor (T1) in response to the low-voltage scanning signal applied to the scanning line (GWi).

The storage capacitor (Cst) is connected between the control terminal of the driving transistor (T1) and a driving voltage line for supplying a driving voltage (ELVDD). When the switching transistors (T2) and (T3) are turned on in response to the low-voltage scanning signal applied to the scanning line (GWi), the storage capacitor (Cst) charges a voltage corresponding to the data signal (Vdata) through the diode-connected driving transistor (T1), and maintains the voltage after the switching transistor (T2) and (T3) are turned off.

The switching transistor (T4) includes a control terminal connected to a first initialization scanning line (GIi), a first input/output terminal connected to the control terminal of the driving transistor (T1), and a second input/output terminal connected to an initialization voltage line for supplying an initialization voltage (Vint). The switching transistor (T4) is turned on in response to a low-voltage initialization scanning signal applied to the first initialization scanning line (GIi) to initialize a voltage at a node where the control terminal of the driving transistor (T1) meets (e.g., is connected to) the capacitor (Cst) with an initialization voltage (Vint).

The switching transistors (T5) and (T6) include control terminals connected to an emission scanning line (Ei). The switching transistor (T5) includes a first input/output terminal connected to the driving voltage line (ELVDD) and a second input/output terminal connected to the first input/output terminal of the driving transistor (T1). The switching transistor (T6) includes a first input/output terminal connected to the second input/output terminal of the driving transistor (T1) and a second input/output terminal connected to the organic light emitting element (LD). The switching transistors (T5 and T6) are turned on in response to a low-voltage emission scanning signal applied to the emission scanning line (Ei), and form a current path among the driving voltage line (ELVDD), the driving transistor (T1), and the organic light emitting element (LD). Therefore, the driving transistor (T1) outputs an output current variable by (e.g., based on) a voltage between the control terminal of the driving transistor (T1) and the first input/output terminal of the driving transistor (T1), which is the voltage charged in the capacitor (Cst), to the organic light emitting element (LD).

The organic light emitting element (LD) may be an organic light emitting diode (OLED), and may include an anode connected to the second input/output terminal of the switching transistor (T6), and a cathode connected to the common voltage (ELVSS). The organic light emitting element (LD) changes intensity and emits light according to the output current of the driving transistor (T1) to display the image.

The organic light emitting element (LD) may emit one light of primary colors. The primary colors may, for example, include red, green, and blue, and desired colors may be displayed by a spatial sum or a temporal sum of the three primary colors. In this case, some organic light emitting elements (LD) can emit white light. As a result, luminance can be increased. Alternatively, organic light emitting elements (LD) of the pixels (PX) may emit white light, and some subpixels (PX) may further include a color filter that changes white light emitted from the organic light emitting elements (LD) into a primary color light.

Here, a bundle of pixels for expressing desired colors may include three pixels for expressing red, green, and blue, respectively, and may further include a pixel for expressing white.

The switching transistor (T7) includes a control terminal connected to the first initialization scanning line (GIi), a first input/output terminal connected to the initialization voltage line (Vint), and a second input/output terminal connected to the second input/output terminal of the switching transistor (T6) and to the anode of the organic light emitting element (LD). The switching transistor (T7) is turned on in response to the low-voltage initialization scanning signal applied to the first initialization scanning line (GIi) to initialize the anode voltage of the organic light emitting element (LD) with the initialization voltage (Vint).

A method of generating a data signal (DATA) by the data driver 200 will now be described with reference to FIG. 3 and FIG. 4.

Figure 4:
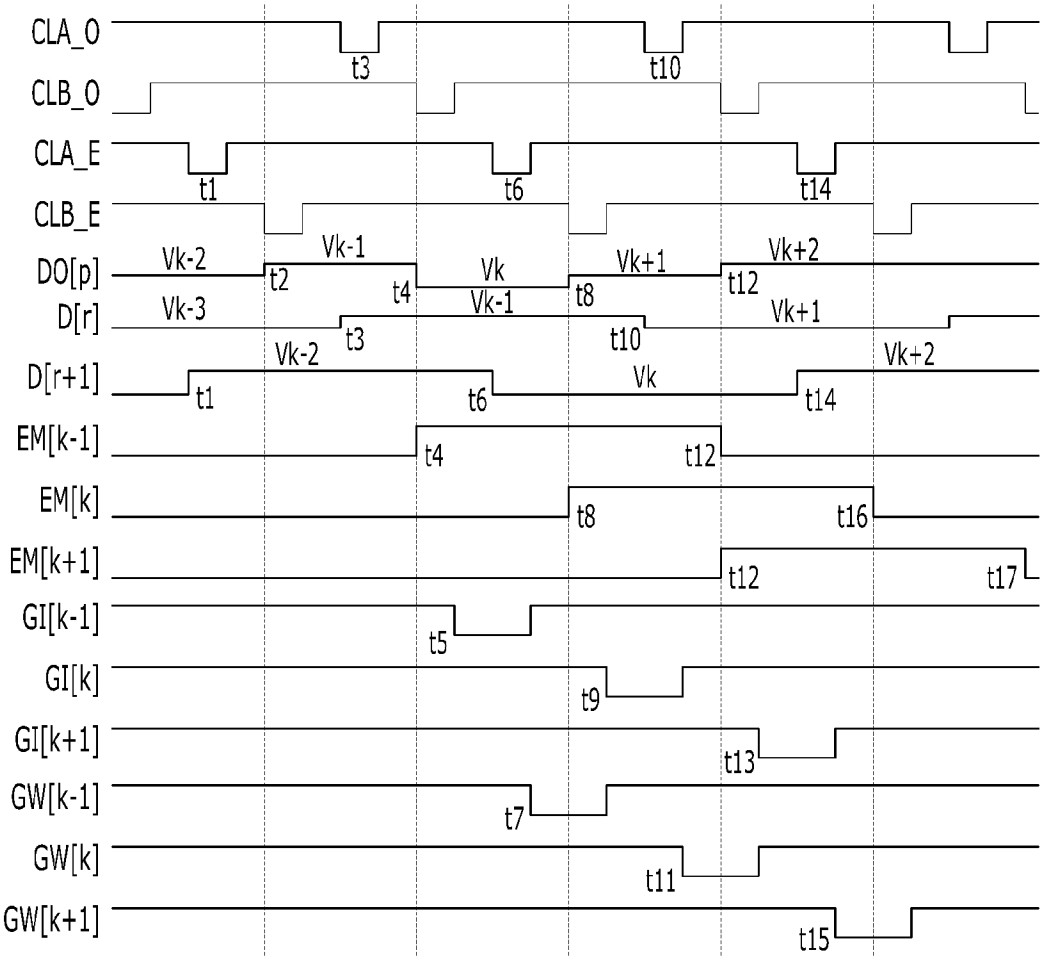
FIG. 4 illustrates a signal timing of FIG. 3.

FIG. 3 illustrates part of a signal divider of FIG. 1 and a corresponding pixel, and FIG. 4 illustrates signal timing of FIG. 3.

Referring to FIG. 3, output lines (DOp and DOp+1, where p=1, 2, 3, . . . , m) neighboring each other from among the plurality of output lines (DO1-DOm), a plurality of demultiplexers (DMp and DMp+1) respectively connected to the output lines (DOp and DOp+1) from among the plurality of demultiplexers (DM1-DMm), a plurality of data lines (Dr, Dr+1, Dr+2, and Dr+3, where r=1, 2, 3, . . . , m) connected to a corresponding demultiplexer from among the plurality of demultiplexers (DMp and DMp+1), and signal lines (GIk−1, GI*k*, GIk+1, GWk−1, GWk, GWk+1, Ek−1, Ek, and Ek+1) of three continuous lines from among signal lines (GI1-GIn, GW1-GWn, E1-En, and D1-D2*m*) are shown.

The demultiplexer (DMp) is connected to a plurality of clock signal lines (CLA_O and CLA_E), and the demultiplexer (DMp+1) is connected to a plurality of clock signal lines (CLB_O and CLB_E). The demultiplexer (DMp) connects the output line (DOp) and the data line (Dr) according to the clock signal (CLA_O), and connects the output line (DOp) and the data line (Dr+1) according to the clock signal (CLA_E). The demultiplexer (DMp+1) connects the output line (DOp+1) and the data line (Dr+2) according to the clock signal (CLB_O), and connects the output line (DOp+1) and the data line (Dr+3) according to the clock signal (CLB_E).

A plurality of pixels (PX) are connected to a corresponding signal line from among signal lines (GIk−1, GIk, GIk+1, GWk−1, GWk, GWk+1, Ek−1, Ek, and Ek+1) of three continuous lines and a corresponding data line from among the plurality of data lines (Dr, Dr+1, Dr+2, and Dr+3).

A parasitic capacitor (Cd1) may be formed between the data line (Dr) and the data line (Dr+1), and a parasitic capacitor (Cd2) may be formed between the data line (Dr+2) and the data line (Dr+3). The plurality of data lines (Dr, Dr+1, Dr+2, and Dr+3) may form a data line capacitor (Cdata).

Here, for example, the data signal supplied to the pixel provided near and above or below the k-th reference pixel may be influenced by the parasitic capacitors (Cd1) and (Cd2) and the data line capacitor (Cdata). The data signal (Vk') influenced by the parasitic capacitors (Cd1 and Cd2) and the data line capacitor (Cdata) is generated as expressed in Equation 1.

$$Vk'=V_k+(V_{k+}1-V_{k-}1)Cd1/\text{Cdata}$$

where Cd1<<<<Cdata, k=1, 2, 3, . . . , n, $V_{k-}1$ is a data signal applied to the (k−1)th pixel, and $V_{k+}1$ is a data signal applied to the (k+1)th pixel.

Referring to FIG. 4, an output signal (D[r]) with a level Vk−3 is applied to the data line (Dr) before a time t1, and the data signal generator 220 generates a data signal (DO[p]) with a level Vk−2.

At the time t1, a data signal (D[r+1]) with a level Vk−2 is applied to the data line (Dr+1) according to a clock signal (CLA_E).

At the time t2, the data signal generator 220 generates an output signal (DO[p]) with a level Vk−1.

At a time t3, a data signal (D[r]) with a level of Vk−1 is applied to the data line (Dr) according to a clock signal (CLA_O).

At a time t4, the data signal generator 220 generates an output signal (DO[p]) with a level of Vk based on (e.g., in consideration of) an influence caused when the level of the signal (D[r]) is changed to Vk−1 from Vk−3.

In detail, referring to FIG. 3, the data signal generator 220 generates an output signal (DO[p]) with a level of Vk written to the reference pixel (PX) based on (e.g., in consideration of) the influence caused when the level of the signal (D[r]) written to the pixel (e.g., first reference pixel PX) connected to the scanning line (GWK) and the pixel (PX) connected to the scanning line (GWK−1) is changed to Vk−1 from Vk−3.

In this instance, the data signal generator 220 performs the operations of Equation 2. Equation 2(a) represents an equation for generating an output signal (DO[p]) with a level of Vk applied to the first reference pixel (PX), and Equation 2(b) represents an equation for indicating a change (ΔVk) of a data voltage when the output signal (DO[p]) with a level of Vk applied to the reference pixel (PX) and the change of the data signal supplied to the pixel (PX) connected to the scanning line (GWK−1) influences the reference pixel by the coupling of the parasitic capacitors (Cd1, Cdata).

$$V_k=V_k-(V_{k+1}-V_{k-1})(Cd1/\text{Cdata}) \quad \text{(a)}$$

$$\Delta V_k=V_k-(V_{k+1}-V_{k-1})(Cd1/\text{Cdata})-(V_{k+2}-2V_k+V_{k-2})(Cd1/\text{Cdata})\wedge 2 \quad \text{(b)}$$

$$V_k=V_k-(V_{k+2}-2V_k+V_{k-2})(Cd1/\text{Cdata})\wedge 2 \quad \text{(c) Equation 2}$$

As a result, as expressed in Equation 2(c), it is found that regarding the data signal (D[r+1]) with a level of $V_k$, the influence of the parasitic capacitors (Cd1, Cdata) is reduced by the square of Cd1/Cdata, which is higher than the reduction of Cd1/Cdata for the data signal level (Vk') to which the data processing of Equation 1 is applied.

Further, the emission controller 500 applies an emission control signal (E[k−1]) with a disable level to the emission scanning line (Ek−1). Therefore, the switching transistors (T5 and T6) of the pixel (PX) connected to the emission scanning line (Ek−1) are turned off.

At a time t5, an initialization scanning signal (GI[k−1]) with an enable level is applied to the scanning line (GI(k−1)). Therefore, the gate electrode of the driving transistor (T1) of the pixel (PX) connected to the scanning line (GI(k−1)) and the anode of the organic light emitting element (LD) are initialized with an initialization voltage (Vint).

At a time t6, the data signal (D[r+1]) with a level of Vk is applied to the data line (Dr+1) according to the applied data clock signal (CLA_E).

At a time t7, a data signal (D[r+1]) with a level of Vk is applied to the pixel (PX) connected to the scanning lines (GIk−1, GWk−1).

At a time t8, the data signal generator 220 generates an output signal (DO[p]) with a level of Vk+1 by performing the operation of Equation 3 (described below) based on (e.g., in consideration of) the influence of the parasitic capacitor (Cdata) according to the parasitic capacitor (Cd1) and the data line (Dr) caused by the change of the level of the data signal (D[r]) from Vk−3 to Vk−1 and from Vk to Vk+1, and the changes of the level of the data signal (D[r+1]) from Vk−2 to Vk.

Here, the data signal generator 220 performs the operations of Equation 3. Equation 3(a) represents an equation for generating an output signal (DO[p]) with a level of Vk+1 applied to the first reference pixel (PX). Equation 3(b) indicates an equation for showing a change (ΔVk+1) of a data voltage when the output signal (DO[p]) with a level of Vk+1 is applied to the reference pixel (PX), the change of the data signal supplied to the pixel (PX) connected to the scanning line (GWK−1), and the change of the data signal supplied to the pixel (PX) connected to the scanning line (GWK+1) influence the reference pixel according to the coupling of the parasitic capacitors (Cd1, Cdata).

$$V_{k+1}=V_k-(V_{k+1}-V_{k-1})Cd/\text{Cdata}+(V_{k+2}2V_k+22V_k-2)(Cd/\text{Cdata})\wedge 2 \quad \text{(a)}$$

$$\Delta V_{k+1}=V_k-(V_{k+1}-V_{k-1})(Cd/\text{Cdata})-(V_{k+2}-2V_k+V_{k-2})(Cd/\text{Cdata})\wedge 2+(V_{k+3}-V_{k+1}+3V_{k-1}-V_{k-3})(Cd/\text{Cdata})\wedge 3 \quad \text{(b)}$$

$$V_{k+1}=V_k+(V_{k+3}-V_{k+1}+3V_{k-1}-V_{k-3})(Cd/\text{Cdata})\wedge 3 \quad \text{(c) Equation 3}$$

As a result, as shown in Equation 3(c), it is found that regarding the output signal (DO[p]) with a level of Vk+1, the influence of the parasitic capacitors (Cd, Cdata) is reduced by a cube of Cd/Cdata, which is higher than the reduction of Cd/Cdata for the data signal level (Vk') to which the data processing of Equation 1 is applied.

Further, the emission controller 500 applies an emission control signal (E[k]) with a disable level to the emission scanning line (Ek) to turn off the switching transistors T5 and T6 of the pixel (PX) connected to the emission scanning line (Ek).

At a time t9, an initialization scanning signal (GI[k1]) with an enable level is applied to the scanning line (GIk). Therefore, the gate of the driving transistor (T1) of the pixel (PX) connected to the scanning line (GIk) and the anode of the organic light emitting element (LD) are initialized with an initialization voltage (Vint).

At a time t10, the data signal (D[r]) with a level of Vk+1 is applied to the data line (Dr) according to the clock signal (CLA_O).

At a time t11, the data signal (D[r]) with the level of Vk+1 is written to the pixel (PX) connected to the data line (Dr).

At a time t12, the data signal generator 220 generates an output signal (DO[p]) with a level of Vk+2 based on (e.g., in consideration of) the influence of the parasitic capacitor (Cd1) caused when the level of the data signal (D[r]), changed on the data line (Dr) around the time t3, changes from Vk−3 to Vk−1, based on the influence of the parasitic capacitor (Cd1) caused when the level of the data signal (D[r+1]), changed on the data line (Dr+1) around the time t6, changes from Vk−2 to Vk, and based on the influence of the parasitic capacitor (Cd1) caused when the level of the data signal (D[r]), changed on the data line (Dr) around the time t10, changes from Vk−1 to Vk+1.

Further, the emission controller 500 applies an emission control signal (E[k−1]) with an enable level to the emission scanning line Ek−1 to turn on the switching transistors (T5 and T6) of the pixel (PX) connected to the emission scanning line (Ek−1). The emission controller 500 applies an emission control signal (E[k+1]) with a disable level to the emission scanning line (Ek+1) to turn off the switching transistors (T5 and T6) of the pixel (PX) connected to the emission scanning line (Ek+1).

At a time t13, initialization scanning signal (GI[k+1]) with an enable level is applied to the scanning line (GIk+1). Therefore, the gate electrode of the driving transistor (T1) of the pixel (PX) connected to the scanning line (GIk+1) and the anode electrode of the organic light emitting element (LD) are initialized with an initialization voltage (Vint).

At a time t14, a data signal (D[r+1]) with a Vk+2 level is applied to the data line (Dr+1) according to the clock signal (CLA_E).

At a time t15, a data signal (D[r+1]) with a level of Vk+2 is written to the pixel (PX) connected to the data line (Dr+1).

At a time t16, the emission controller 500 applies an emission control signal (E[k]) with an enable level to the emission scanning line (Ek) to turn on the switching transistors (T5 and T6) of the pixel (PX) connected to the emission scanning line (Ek).

At a time t17, the emission controller 500 applies an emission control signal (E[k+1]) with an enable level to the emission scanning line (Ek+1) to turn on the switching transistors (T5 and T6) of the pixel (PX) connected to the emission scanning line (Ek+1).

The method for performing a data processing operation by using a data line connected to two or three pixels provided to an upper side and a lower side of the data signal generator has been described, but the exemplary embodiment is not limited thereto, and the data signal generator 220 may generate a data signal by reducing the effect of the coupling of the parasitic capacitor (Cd) among data lines of at least three pixels provided near an upper side and a lower side and the effect of the coupling of the parasitic capacitor (Cdata) formed by the pixel data line according to a value of the Cd/Cdata.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "under" other elements or features would then be oriented "above" the other elements or features. In addition, it will also be understood that when a layer is referred to as being "between" two elements, it can be the only layer between the two elements, or one or more intervening elements may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The terms "module" and "unit" for components used in the following description are used only in order to make the specification easier. Therefore, these terms do not have meanings or roles that distinguish them from each other by themselves. Singular forms are to include plural forms unless the context clearly indicates otherwise.

While this disclosure has been described in connection with what is presently considered to be exemplary embodiments, it is to be understood that the invention is not limited to the disclosed embodiments, but, on the contrary, is intended to cover various modifications and equivalent arrangements included within the spirit and scope of the appended claims, and equivalents thereof. Therefore, the above-detailed description is not to be interpreted as being restrictive, but is to be considered as being illustrative. The scope of the present invention is to be determined by reasonable interpretation of the claims, and all alterations within equivalences of the present invention fall within the scope of the present invention.

What is claimed is:

1. A display device comprising:

a display comprising a first pixel connected to a first data line and a second pixel connected to a second data line;

a data signal generator configured to generate an output signal; and a signal divider configured to divide the output signal, to generate a first data signal and a second data signal, and to apply the first data signal and the second data signal to the first data line and the second data line, respectively, wherein the data signal generator is configured to generate the output signal based on a coupling effect of a first parasitic capacitor formed between the first data line and the second data line and a coupling effect of a parasitic data line capacitor of a data line formed by each of the first data line and second data line.

2. The display device of claim 1, wherein the data signal generator is configured to generate the output signal based on a first coupling effect of the first parasitic capacitor caused when the first data signal changes from a first level to a second level at a first time and the coupling effect of the parasitic data line capacitor of the data line.

3. The display device of claim 1, wherein the first pixel and the second pixel are adjacent each other in a vertical direction.

4. The display device of claim 1, wherein the first data signal changes from a first level to a second level at a first time, and wherein the generated output signal is written to the second pixel at a second time.

5. The display device of claim 4, wherein the generated output signal reduces the coupling effect of the parasitic capacitor in proportion to a square of a ratio of the first parasitic capacitor to the parasitic capacitor of the data line.

6. The display device of claim 1, wherein the data signal generator is configured to generate the output signal based on a first coupling effect, a second coupling effect of the first parasitic capacitor caused when the second data signal changes from a third level to a fourth level at a third time, and the coupling effect of the parasitic data line capacitor of the data line.

7. The display device of claim 1, further comprising a third pixel connected to the first data line and below the first pixel, wherein the second pixel is between the first pixel and the third pixel in a vertical order.

8. The display device of claim 1, wherein the generated output signal is written to the second pixel based on a first coupling effect, a second coupling effect of the first parasitic capacitor caused when the second data signal changes from a third level to a fourth level at a third time, and the coupling effect of the parasitic data line capacitor of the data line.

9. The display device of claim 1, wherein the generated output signal generated based on a first coupling effect, a second coupling effect of the first parasitic capacitor caused when the second data signal changes from a third level to a fourth level at a third time, and a coupling effect of the parasitic capacitor of the data line reduces a coupling effect of the parasitic capacitor in proportion to a cube of a ratio of the first parasitic capacitor to the parasitic capacitor of the data line.

* * * * *